US005152460A

United States Patent [19]

Barty

[11] Patent Number: 5,152,460

[45] Date of Patent: Oct. 6, 1992

[54] SPRAY GUN NOZZLE HEAD

[76] Inventor: Thomas Barty, 13415 Vine Maple Dr., White Rock, British Columbia, Canada, V4A 2X7

[21] Appl. No.: 682,798

[22] Filed: Apr. 8, 1991

[51] Int. Cl.[5] ..... B05B 1/28

[52] U.S. Cl. ..... 239/290; 239/300; 239/526

[58] Field of Search ..... 239/290, 296, 297, 525, 239/526, 291, 292, 293, 294, 295, 299, 300, 301, 298, 11, 8

[56] References Cited

U.S. PATENT DOCUMENTS

| | | | |
|---|---|---|---|
| 1,369,520 | 2/1921 | Day | 239/11 |
| 2,029,423 | 2/1936 | Gustafsson | 299/140 |
| 2,214,035 | 9/1940 | Tracy | 239/290 |
| 2,247,000 | 6/1941 | Popoff | 239/8 |
| 2,475,000 | 7/1949 | Beach, Jr. . | |
| 2,867,476 | 5/1956 | Siefen | 299/86 |
| 3,463,395 | 8/1969 | Binoche | 239/15 |
| 3,521,824 | 7/1970 | Wilcox | 239/299 |
| 3,658,255 | 4/1972 | Beall, Jr. | 239/415 |
| 3,746,253 | 7/1973 | Walberg | 239/15 |
| 3,841,555 | 10/1974 | Lilja | 239/8 |
| 4,154,403 | 5/1979 | Forrester | 239/528 |
| 4,657,184 | 4/1987 | Weinstein | 239/296 |
| 4,844,342 | 7/1989 | Foley | 239/70 |
| 4,844,347 | 7/1989 | Konhawser et al. | 239/296 |
| 4,848,665 | 7/1989 | Smith | 239/411 |
| 4,959,159 | 9/1990 | Mattson | 239/290 |

FOREIGN PATENT DOCUMENTS

| | | | |
|---|---|---|---|
| 858769 | 10/1952 | Fed. Rep. of Germany | 239/290 |
| 1155919 | 5/1958 | France | 239/528 |

*Primary Examiner*—Andres Kashnikow
*Assistant Examiner*—Christopher G. Trainor
*Attorney, Agent, or Firm*—Townsend and Townsend

[57] ABSTRACT

A spray gun nozzle head for atomizing a liquid using a flowing pressurized gas. The nozzle head includes a central nozzle having an orifice for supplying the liquid to be atomized. A cap having a funnel shaped chamber is mountable over the nozzle to define an annular passage for supplying the pressurized gas. The cap has an orifice alignable with the nozzle orifice such that the nozzle orifice is recessed upstream from the cap orifice to define a region adjacent the nozzle orifice in which the liquid is atomized by the pressurized gas into a liquid spray prior to being expelled through the cap orifice.

7 Claims, 2 Drawing Sheets

SPRAY GUN NOZZLE HEAD

FIELD OF THE INVENTION

This invention relates to a spray gun nozzle head for atomizing a liquid using a flowing pressurized gas and is particularly suited, but not limited, to applying paints, varnishes, glues and the like using a high volume low pressure (HVLP) spray gun.

BACKGROUND OF THE INVENTION

Spray guns for applying paint to a surface are well known. Examples of spray guns and associated spray equipment can be found in the following patents:

U.S. Pat. No. 3,463,395 to Binoche
U.S. Pat. No. 4,848,665 to Smith
U.S. Pat. No. 2,029,423 to Gustafsson
U.S. Pat. No. 3,746,253 to Walberg
U.S. Pat. No. 2,867,476 to Siefen
U.S. Pat. No. 4,844,347 to Konhauser et al.
U.S. Pat. No. 4,154,403 to Forrester
U.S. Pat. No. 3,841,555 to Lilja
U.S. Pat. No. 4,844,342 to Foley
U.S. Pat. No. 3,658,255 to Beall, Jr.

In recent years, high volume low pressure (HVLP) spray gun systems have become popular as they offer better transfer efficiency and a good quality finish on surfaces. Examples of patents covering HVLP spray gun systems are found in U.S. Pat. Nos. 4,905,905, 4,915,303 and 4,948,053.

An important feature of HVLP systems is that use of low pressure air (in the range of 0–20 psi) makes it easier to control the spray pattern created by the spray gun. In older high pressure spray systems, the high pressure air used tends to create an uncontrolled fogging spray cloud due to the fact that the high pressure air expands rapidly on leaving the spray gun. Rapid expansion of the spray results in as little as 30 per cent of the paint atomized being delivered to the surface to be painted.

Besides wasting expensive paint, high pressure air systems or any other spray system that creates a large cloud of atomized particles is a potential health hazard. In the United States, a number of states have enacted legislation to protect the environment from harmful Volatile Organic Compounds. This new legislation requires a spray transfer efficiency of approximately 65%. Since high pressure systems tend to deliver only 25 to 30% transfer efficiency and some HVLP systems begin at a transfer efficiency of 65%, it is easy to see why HVLP systems have become so popular.

HVLP systems presently in use can be improved upon. Low pressure air is not normally as efficient at atomizing the liquid to be sprayed. In general, if the atomization of the paint is improved, the surface quality of the resulting paint job is also improved.

SUMMARY OF THE INVENTION

The present invention provides a spray gun nozzle head that can be used in low pressure systems. The nozzle head of the present invention provides improved atomization of the liquid to be sprayed within the low pressure air stream to allow for better quality surface finishes.

The present invention provides a spray gun nozzle head for atomizing a liquid using a flowing pressurized gas comprising:

a central nozzle having an orifice for supplying said liquid to be atomized;

a cap having a funnel shaped chamber mountable over said nozzle to define an annular passage for supplying said pressurized gas;

said cap having an orifice alignable with said nozzle orifice such that said nozzle orifice is recessed upstream from said cap orifice to define a region adjacent said nozzle orifice in which said liquid is atomized by said pressurized gas into a liquid spray prior to being expelled through said cap orifice.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
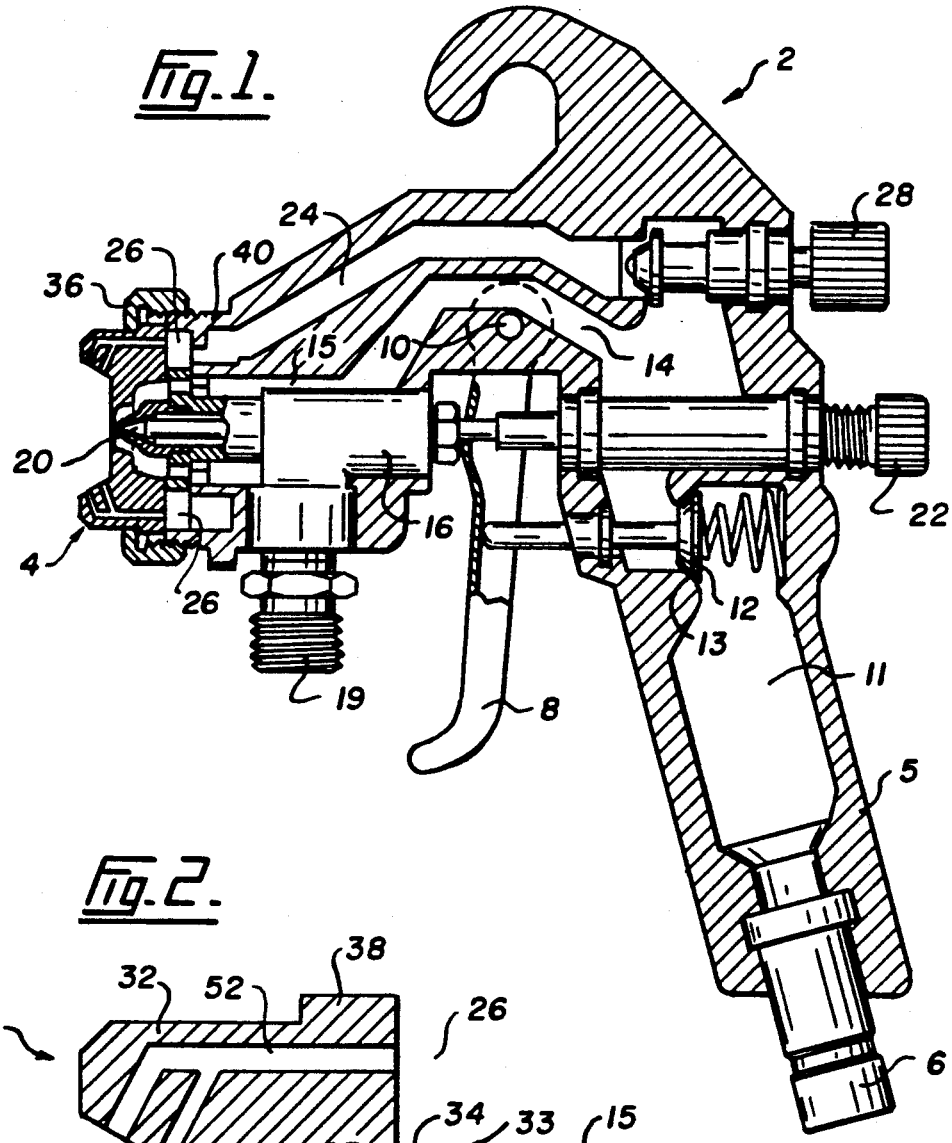
FIG. 1 is section view through a conventional spray gun equipped with a spray nozzle according to a first embodiment of the present invention.

Referring to FIG. 1, there is shown a spray gun 2 fitted with a nozzle head 4 according to a first embodiment of the present invention. Spray gun 2 is typical of a current HVLP spray gun. The spray gun is provided with a handle grip 5 to which a supply of pressurized gas such as air is connected at inlet 6. Lever 8 is pivotally mounted about pin 10 and is used to unseat valve 12 from seat 13. Pressurized air travels through handle passage 11 and into lower passage 14 which leads to a central passage 15 in which fluid block 16 is housed. A substantial portion of the air flows around fluid block 16 in central passage 15 to nozzle head 4 to be used for atomization of liquid as will be explained in detail.

A source of fluid to be atomized is attached to threaded inlet 19 by a suitable coupling. Central passage 15 is provided with an outlet (not shown) through which a small portion of air is diverted. The outlet communicates with the source of fluid to be atomized in order to pressurize the fluid and deliver it through inlet 19 to the sealed interior of the fluid block. Valve means in the form of needle valve 20 is provided within the fluid block to control delivery of the fluid. Needle valve 20 is also controlled by lever 8. Needle valve 20 can be manually adjusted using screw knob 22.

Upper air passage 24 is provided to deliver pressurized air to an outer annular passage 26 that surrounds central passage 15. Air in passage 26 is used to control the shape of the atomized liquid spray produced by the spray gun so that various fan spray patterns can be created. Manually adjustable fan control valve 28 is provided to adjust the flow of air through passage 24.

The foregoing description of a spray gun is entirely conventional. The present invention relates to an arrangement of the spray gun nozzle head that provides improved atomization of the spray liquid using low pressure air.

Figure 2:
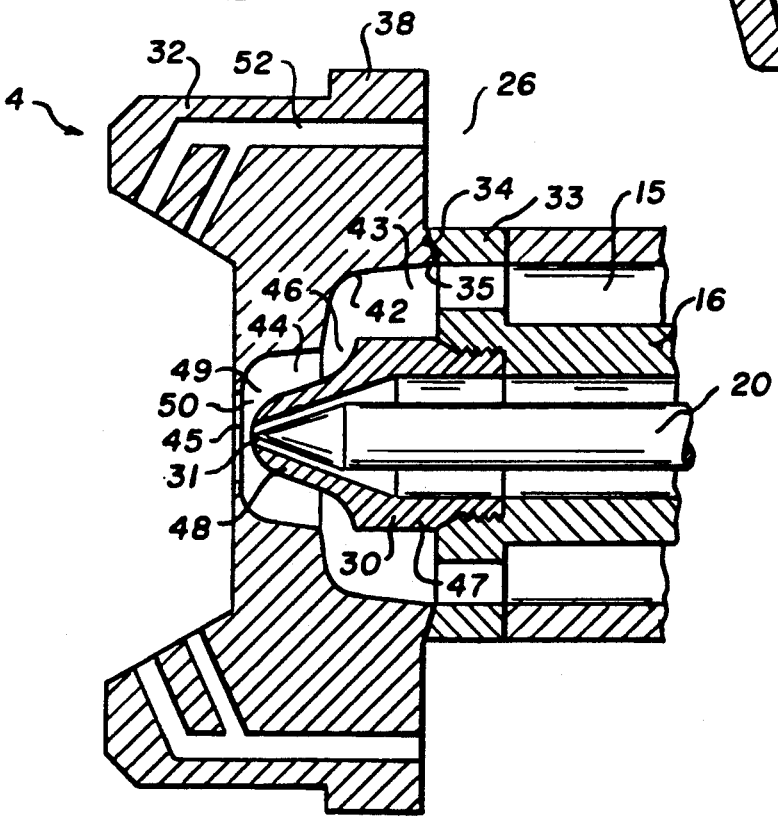
FIG. 2 is a detail cross-section of a first embodiment of the present invention.

FIG. 2 shows a detailed section view of a first embodiment of the spray gun nozzle head of the present invention. In the first embodiment, the head includes a central nozzle 30 that is threaded into the end of fluid block 16. Central nozzle 30 has an orifice 31 for supplying liquid to be atomized. Normally, valve means in the form of needle valve 20 acts to block orifice 31 to prevent flow of pressurized liquid from the upstream supply. Needle valve 20 blocks nozzle orifice 31 unless retracted upstream by a user pulling lever 8.

A cap 32 is mountable over nozzle 30. Fluid block 16 is formed with an annular flange 33 having a sloped shoulder 34. Cap 32 is formed with a corresponding sloped shoulder 35 which engages shoulder 34 to seal the cap over nozzle 30. As best shown in FIG. 1, a retaining ring 36 engages outer flange 38 of cap 32 and is threaded onto gun barrel 40 to retain the cap over the nozzle. This cap mating and retaining arrangement is conventional and allows for easy dismantling of the spray gun head for cleaning and maintenance.

Cap 32 is formed with a funnel shaped chamber 42 that surrounds nozzle 30 when the cap is positioned over the nozzle to define an annular passage 43 for supplying pressurized air. Annular passage 43 communicates with central passage 15 of the spray gun.

In the first embodiment, cap 32 is formed with a first upstream funnel shaped chamber 43 from which extends a second smaller concentric downstream funnel shaped chamber 44. Second chamber 44 is formed with a cap orifice 45. In the arrangement of FIG. 1, central nozzle 30 tapers in a downstream direction from an annular shoulder 47 positioned within first chamber 43 to a narrowed tip 48 positioned within second chamber 44. Cap orifice 45 is alignable with nozzle orifice 31 such that the nozzle orifice is recessed upstream from the cap orifice to define a region 50 adjacent the nozzle orifice in which liquid supplied through nozzle orifice 31 is atomized by pressurized gas into a liquid spray prior to being expelled through the cap orifice.

In the present embodiment, region 50 is a low pressure region created at narrowed nozzle tip 48 due to the air flow through the various passages of the nozzle head. Air flow entering first chamber 43 from passage 15 results in a low pressure area developing on the curved outer surface of the chamber. The air at the outer surface of the chamber has a greater distance to travel, so the outer air flow speeds up resulting in an initial decrease in pressure at the outer surface of the chamber. In addition, air flow must pass through the constriction 46 created between nozzle shoulder 47 and surface of first chamber 43. Due to the Venturi effect, there is a lowering of pressure in this region. At the changeover from first chamber 43 to second chamber 44, air flow is deflected to the tapered surface of nozzle 30 and a corresponding low pressure region 50 develops adjacent nozzle tip 48. Again, the constriction 49 between nozzle tip 48 and the surface of second chamber 44 assists in the formation of low pressure region 50.

Pressurized liquid expelled from nozzle orifice 31 enters low pressure region 50 adjacent tip 48 and begins to expand, atomize and mix within the air in the low pressure region. The outer diameter of cap orifice 45 is at a relatively higher pressure than region 50 and hence the atomized spray flow is constricted to a narrow stream flow through the orifice. This is important to prevent the spray flow from expanding rapidly into an uncontrolled spray that coats the internal passages of the nozzle head. Once through cap orifice 45, the already atomized spray encounters atmospheric pressure and expands rapidly in a circular spray pattern where further atomization takes place.

Once through cap orifice 45, the shape of the spray pattern is controlled by conventional fan horn passages 52 formed in the cap. Horn passages 52 comprise opposed pressurized gas passages that open downstream of the cap orifice and are directed substantially laterally to the flow of the liquid spray to control the shape of the spray as it leaves the nozzle head. Pressurized air is supplied to horn passages 52 through annular passage 26 as best shown in FIG. 1. Depending on the amount of air diverted to the horn passages, the spray pattern can be flattened from an essentially circular pattern to an elongated ellipsoid. Note that cap 32 can be rotated beneath retaining ring 36 against shoulder 34 to permit the orientation of the spray pattern to be adjusted which is conventional.

Prior art spray guns rely on atomization of the liquid spray downstream of the cap orifice. In the present invention, recessing the nozzle behind the cap orifice creates an initial low pressure atomization region 50 not found in prior art designs that substantially increases atomization of the liquid spray and leads to improved surface finish.

In prototype testing, the arrangement of the present invention was found to deliver best performance when nozzle orifice 31 was recessed upstream of cap orifice a distance in the range of about 50/1000 of an inch to 110/1000 of an inch.

The improved atomization abilities of the present invention are emphasized when one considers that in testing the spray head was able to atomize and spray a water based glue that prior art equipment was unable to atomize.

Figure 3:
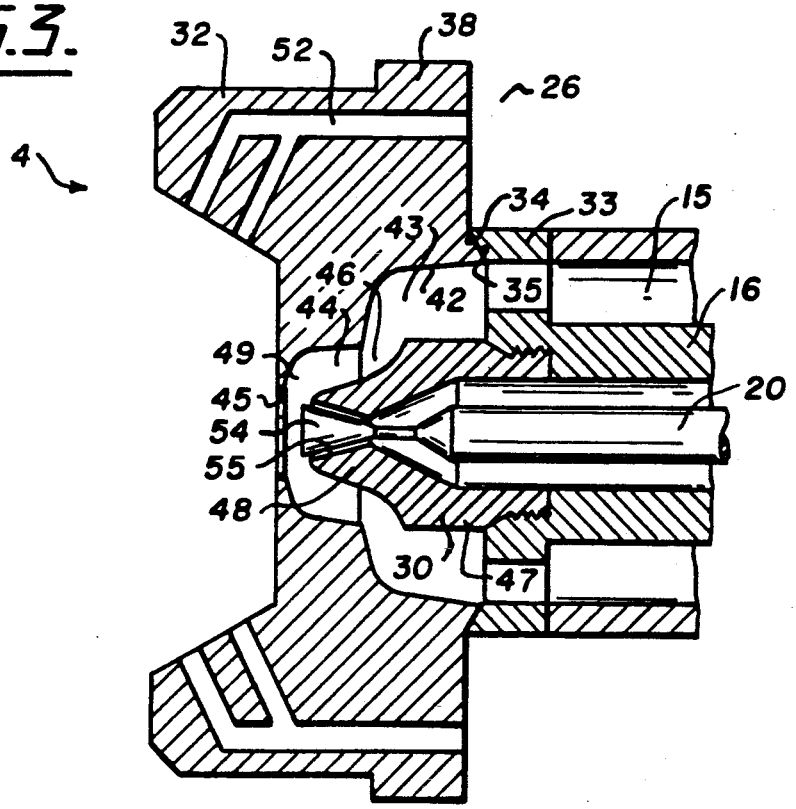
FIG. 3 is a detail cross-section view of a second embodiment of the present invention.

FIG. 3 illustrates a second embodiment of the present invention which is identical to the first embodiment except for the presence of alternative valve means. In the embodiment of FIG. 3, identical features to the embodiment of FIG. 1 are labelled with the same reference numerals.

In FIG. 3, the valve means comprises a needle valve 20 that acts to block nozzle orifice 31 unless advanced downstream of the nozzle orifice. Needle valve 20 is formed with a conical head 54 that expands in a downstream direction and is adapted to seat in a correspondingly shaped nozzle orifice 55. Opening orifice 55 involves advancing the needle downstream 20. The operation of lever 8 is modified by a suitable cam arrangement that advances needle 20 rather than retracting it when lever 8 is depressed by a user. When needle 20 is advanced, conical head 54 injects a thin angled stream of pressurized fluid into low pressure region 50 to be atomized. As conical head 54 is advanced, air flow in region 50 is disturbed leading to increased turbulence and improved atomization and mixing of the spray liquid.

Figure 4:
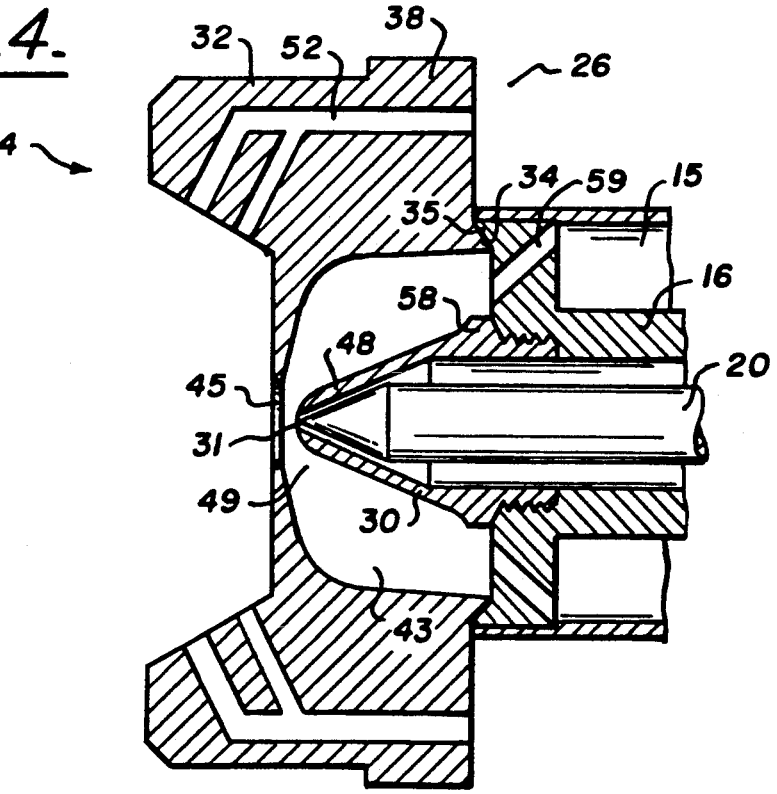
FIG. 4 is a detail cross-section of a third embodiment of the present invention.

FIG. 4 illustrates a third embodiment of the present invention. Once again, features of the present embodiment common to previous embodiments are identically labelled. In the embodiment of FIG. 4, central nozzle 30 tapers in a downstream direction from a wide base 58 to a narrowed tip 48 and a single funnel shaped chamber 43 is formed in cap 32. To ensure that air flow follows the surface of nozzle 30, air flow from spray gun passages 15 is directed by angled passages 59 to flow over nozzle 30. Constriction 49 between nozzle tip 48 and the surface of funnel chamber 43 causes reduced pressure adjacent the tip due to a Venturi effect. In region 50 this low pressure region acts to atomize the liquid injected into the air flow by nozzle orifice 31. A relatively high pressure region about the outer edges of funnel chamber 43 and cap orifice 45 ensure that the stream of atomized liquid is restricted to a narrow stream until the liquid encounters the atmospheric pressure outside cap orifice 45 where horn passages 52 are used to control and limit the spray pattern.

Although the present invention has been described in some detail by way of example for purposes of clarity and understanding, it will be apparent that certain changes and modifications may be practised within the scope of the appended claims.

I claim:

1. A spray gun nozzle head for atomizing a liquid using a flowing pressurized gas comprising:

a tapered central nozzle having an orifice for supplying said liquid to be atomized, said nozzle tapering in a downstream direction from an annular shoulder to a narrowed tip formed with said orifice;

a cap having a compound funnel shaped configuration defined by a first upstream chamber of generally concave shape and a second smaller concentric downstream chamber of generally concave shape extending directly from said first upstream chamber, said second chamber having a cap orifice;

said cap being mountable over said nozzle to define an annular passage for supplying said pressurized gas in which said annular shoulder of said nozzle is positioned within said first chamber to create a first constriction in said annular passage and said narrowed tip is positioned within said second chamber to create a second constriction in said annular passage;

said cap orifice being aligned with said nozzle orifice such that said nozzle orifice is recessed upstream from said cap orifice to define a region within said second chamber adjacent said nozzle orifice in which said liquid is atomized by said pressurized gas into a liquid spray prior to being expelled through said cap orifice.

2. A spray gun nozzle head as claimed in claim 1 in which said central nozzle is provided with valve means to control the flow of said liquid through said nozzle orifice.

3. A spray gun nozzle head as claimed in claim 2 in which said valve means comprises a needle valve that acts to block said nozzle orifice unless retracted upstream from said nozzle orifice.

4. A spray gun nozzle head as claimed in claim 2 in which said valve means comprises a needle valve that acts to block said nozzle orifice unless advanced downstream of said nozzle orifice.

5. A spray gun nozzle head as claimed in claim 4 in which said needle valve is formed with a conical head that expands in a downstream direction adapted to seat in a correspondingly shaped nozzle orifice.

6. A spray gun nozzle head as claimed in claim 1 in which said cap is formed with opposed pressurized gas passages that open downstream of said cap orifice and are directed substantially laterally to the flow of said liquid to control the shape of said liquid spray as it leaves the nozzle head.

7. A spray gun nozzle head as claimed in claim 1 in which said nozzle orifice is recessed upstream of said cap orifice a distance in the range of about 50/1000 of an inch to 110/1000 of an inch.

* * * * *